US005423423A

United States Patent [19]

Sato et al.

[11] Patent Number: 5,423,423

[45] Date of Patent: Jun. 13, 1995

[54] WRAPPING FILM FOR A WRAPPED ARTICLE

[75] Inventors: Makoto Sato; Takayoshi Ose, both of Kanagawa; Kazuaki Taga; Satoshi Aramaki, both of Tokyo, all of Japan

[73] Assignee: Fuji Photo Film Co., Ltd., Kanagawa, Japan

[21] Appl. No.: 167,200

[22] Filed: Dec. 16, 1993

[30] Foreign Application Priority Data

Dec. 17, 1992 [JP] Japan ..... 4-354699

[51] Int. Cl.[6] ..... B43M 7/00; B65D 85/575

[52] U.S. Cl. ..... 206/387.1; 229/241; 229/87.05

[58] Field of Search ..... 206/525, 387; 229/200, 229/203, 241, 87.05, 237

[56] References Cited

U.S. PATENT DOCUMENTS 2,868,432 1/1959 Guyer ..... 229/241
3,403,840 10/1968 Mathes ..... 229/87.05 X
3,485,345 12/1969 Deasy ..... 229/87.05
4,089,410 5/1978 Bolanowski et al. ..... 229/87.05 X
4,782,956 11/1988 Yoshizawa ..... 229/203

FOREIGN PATENT DOCUMENTS 0226835 7/1987 European Pat. Off. .
3337716 4/1985 Germany .
8706379 9/1988 Germany .
9005297 8/1990 Germany .
1105735 3/1968 United Kingdom .

*Primary Examiner*—Jacob K. Ackun
*Attorney, Agent, or Firm*—Sughrue, Mion, Zinn, Macpeak & Seas

[57] ABSTRACT

A wrapping film having a barrel seal portion made up of both end portions of the wrapping film which are overlapped with each other and sealingly welded together, and a slit for unwrapping the film along the barrel seal portion. The slit is formed across the barrel seal portion, whereby, in unwrapping it, the wrapping film is widely torn to expose the wrapped article with ease.

7 Claims, 5 Drawing Sheets

WRAPPING FILM FOR A WRAPPED ARTICLE

BACKGROUND OF THE INVENTION

The present invention relates to a wrapping film for a wrapped article is provided by wrapping an article with a wrapping film, and, more particularly, to a wrapped article which is provided by such as an encased magnetic tape cassette. The wrapping film is adhered to the article and must be removed prior to using the article.

Some articles displayed at stores, such as encased magnetic tape cassettes, are uniform in configuration and relatively small in size. When those articles are shipped from the factory, in order to protect them from dust or moisture and to improve their external appearance, they are provided in the form of wrapped articles; that is, they are wrapped with transparent or opaque cellophane film, or lapping films of polyethylene, polypropylene or polyvinyl chloride, or lapping films formed by coating those lapping films with polyvinylidene chloride. Alternatively, when displayed at a store, they are provided as groups of articles which are wrapped together with lapping films, etc.

When it is required to use an article wrapped with a wrapping film of this type, of course it is necessary to remove the wrapping film. In the wrapped article, generally the wrapping film, as shown in FIG. 14, has a tear tape 2 set inside so that the wrapping film can be removed with ease.

More specifically, the tear tape 2 has an end portion 2*a* exposed to the outside. By pulling this end portion 21, the wrapping film 1 can be torn into pieces to expose the article. In addition, a slit 3 is formed in the wrapping film 1 along the end portion 2*a* of the tear tape 2, thus facilitating the tearing of the wrapping film 1. In this case, the wrapping film 1 can be torn along the tear tape 2 beginning with its portion near the end portion 2*a*. More specifically, the wrapping film 1 is torn greatly or into two pieces, thus exposing the article.

In general, the wrapped article is provided by wrapping an article with a wrapping film 1 by so-called "shrink wrapping". That is, in wrapping the article with the wrapping film 1, the latter is suitably stretched or heated at a predetermined temperature, depending on the material of the wrapping film, and then the article is wrapped with the wrapping film thus processed. The wrapping film shrinks so that it sticks firmly to the article, thus improving the external appearance of the article. However, since the wrapping film 1 sticks firmly to the article, it is rather difficult to remove the wrapping film 1 to expose the article. In order to eliminate this difficulty, heretofore a tear tape 2 is provided inside the wrapping film 1, as was described above. The tear tape 2 is effective in tearing the wrapping film of the wrapped article.

However, the employment of the tear tape 2 is disadvantageous in the following points:

In order to provide the tear tape 2 inside the wrapping film 1, it is necessary to provide a certain device suitable for providing the tear tape inside the wrapping film, and to provide a step of providing the tear tape inside the wrapping film. Furthermore, in order to tear the wrapping film with the tear tape 2, the latter must be higher in rigidity than the wrapping film 1. This means an increase of material cost.

On the other hand, depending on the position of the tear tape 2, the wrapping film 1 can be torn into a small piece (a) and a large piece (b). The small piece (a) may be removed readily; however, the large piece (b) may remain as it is although the tear tape 2 has been removed. That is, it is rather troublesome to remove the wrapping film completely.

SUMMARY OF THE INVENTION

In view of the foregoing, an object of this invention is to provide a wrapping film which, when opened, is torn greatly without use of special means, to expose the article with ease.

The foregoing object and other objects of the invention have been achieved by the provision of a wrapping film which has at least a barrel seal portion made up of both end portions of the wrapping film which are overlapped with each other and sealingly welded together by heat, in which, according to the invention, the barrel seal portion has a slit for unwrapping the wrapped article in at least one part thereof.

A mark for locating the slit may be provided beside it, or an arrow mark indicating the direction in which the barrel seal portion should be pulled may be provided on or near the barrel seal portion.

In the wrapped article, the slit may be perpendicular to or oblique with the barrel seal portion, or the slit may be V-shaped or arcuate.

Furthermore, in the wrapped article, one of the edges of the slit may be held raised from the wrapping surface.

In addition, in the wrapped article, the upper and lower films forming the barrel seal portion are shifted from each other in a film tearing direction, so that the slit formed in the lower film is shifted downwardly of the slit formed in the upper film in the film tearing direction.

The nature, utility and principle of the invention will be more clearly understood from the following detailed description and the appended claims when read in conjunction with the accompanying drawings.

DESCRIPTION OF THE PREFERRED EMBODIMENTS

Preferred embodiments of this invention will be described with reference to the accompanying drawings.

First Embodiment

An example of a film wrapping which constitutes a first embodiment of the invention, will be described with reference to FIGS. 1 and 2.

Figure 1:
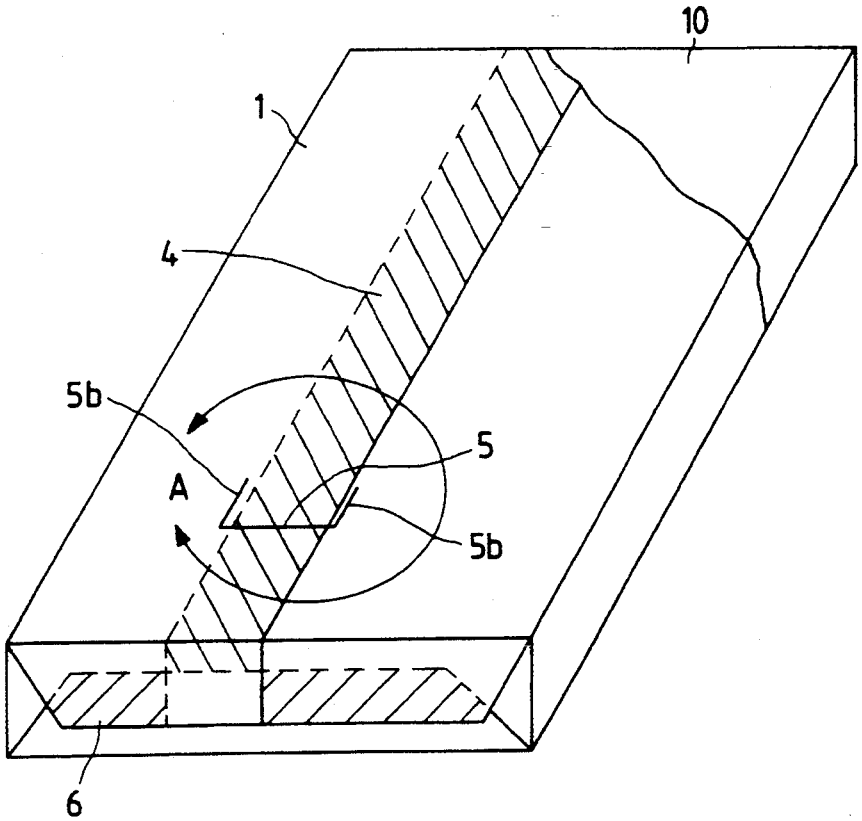
FIG. 1 is a perspective view showing an example of a wrapped article, which constitutes a first embodiment of this invention.
Figure 2:
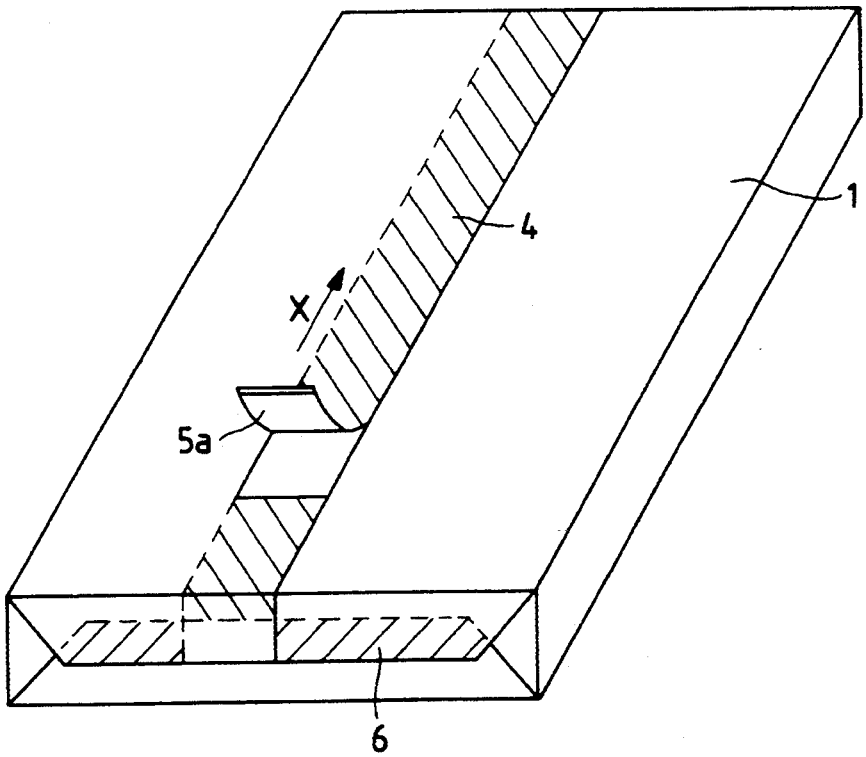
FIG. 2 is a perspective view showing the edge portion of a slit for unwrapping the wrapped article.

In FIGS. 1 and 2, reference numeral 10 designates an article to be wrapped, which is an encased video tape cassette in the form of a rectangular box in this case. Both end portions of a wrapping film 1 are overlapped with each other on the top (the upper major surface) of the article 10 substantially along the central line, and heat-welded together, thus forming a barrel seal portion 4 (which is indicated by oblique lines). The wrapping film 1 is in the form of a quadrangular prism which extends over the cassette. Under this condition, both end portions of the wrapping film 1 are folded over the front and rear ends of the cassette, and welded together to form side seal portions 6, for instance, by heating. Thus, both end portions of the barrel seal portion 4 are integral with respective side seal portions 6.

A slit 5 is formed across the barrel seal portion 4 near one end. When the edge 5*a* of the slit 5 thus formed is pulled in the direction of the arrow X in FIG. 2, the wrapping film 1 is torn along the barrel seal portion 4 which is high in rigidity, being formed by welding both end portion of the wrapping film 1 together. More specifically, the barrel seal portion 4 is torn, or the wrapping film is torn, along the barrel seal portion 4, so that the wrapping film is torn into two pieces on both sides of the barrel seal portion 4. The slit 5 may be modified so that it is U-shaped, thus forming a tearing ear; that is, the slit 5 includes a main portion which is extended across the barrel seal portion 4; and bent portions 5*b* which are extend from both ends of the main portion in the tearing direction.

As was described above, the barrel seal portion 4 formed substantially along the middle of the article 10 in the longitudinal direction extends substantially half way around the article 10, and is connected to the side seal portions 6. Therefore, the wrapping film can be removed as follows: By pulling the edge 5*a* of the slit 5, the wrapping film 1 is torn along the barrel seal portion 4 into two pieces. When the tear in the barrel seal portion 4 reaches the side seal portion 6 in the latter, the tearing direction of the barrel seal portion 4 is changed laterally to tear the folded portions of the wrapping film, thereby to open the wrapping film greatly.

That is, by one action of pulling the edge 5*a* of the slit 5, the wrapping film 1 is torn and opened right and left. As a result, the wrapping film is widely opened. The tear is made over the full longitudinal length of the cassette, and advances right and left. Hence, the wrapping film 1 is removed in such a manner that corners of the article 10 on one side are completely exposed. On the other hand, the wrapping film remaining in the direction opposite to the tearing direction (the wrapping film left below the slit 5 in FIGS. 1 and 2) is removed as follows: The wrapping film 1 remaining there is integral with the wrapping film torn as described above, and therefore it can be readily removed by pulling it after the film tearing operation.

In the conventional wrapped article, the wrapping film is torn into two pieces with the tear tape; however, it is rather difficult to remove from the wrapped article the piece remaining in the direction opposite to the tearing direction. Hence, when compared with the conventional wrapped article, the wrapped article of the invention is advantageous in that the wrapped film can be removed effectively, and it is unnecessary to provide the tear tape, which reduces the manufacturing cost as much.

The slit 5 may be formed after the article 10 has been wrapped with the wrapping film. However, in order to eliminate the difficulty that the article 10 may be damaged by the cutter or the like used to form the slit 5, it is desirable to form the slit 5 in the overlapped portions of the wrapping film before the article is wrapped therewith.

Second Embodiment

Figure 3:
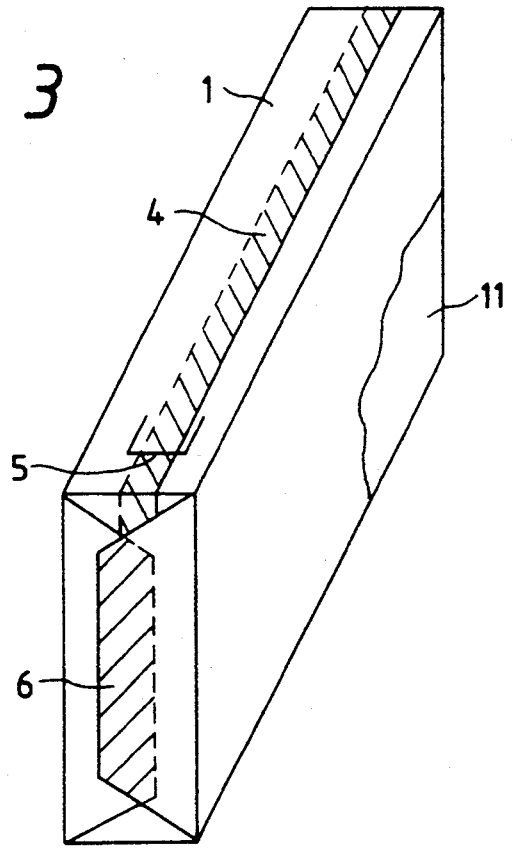
FIG. 3 is a perspective view showing another example of the wrapped article, which constitutes a second embodiment of the invention.
Figure 4:
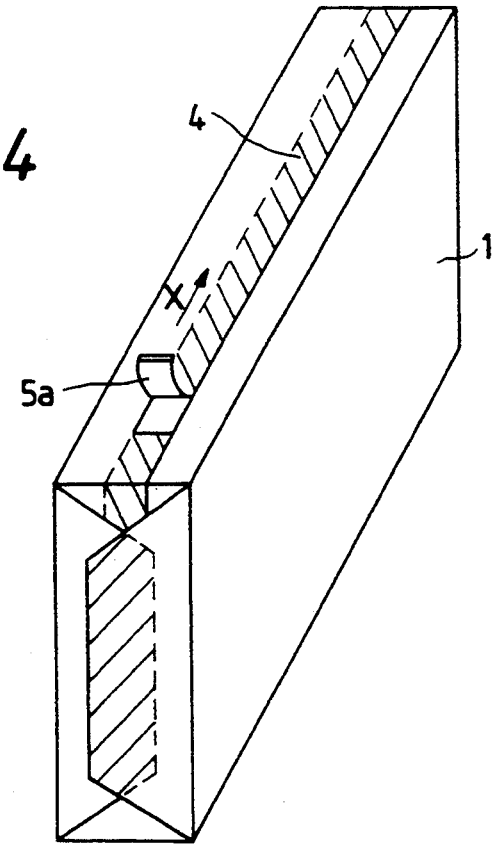
FIG. 4 is a perspective view showing the edge portion of a slit for unwrapping the wrapped article shown in FIG. 3.

Another example of the film wrapping which constitutes a second embodiment of the invention, is as shown in FIGS. 3 and 4.

In the second embodiment, an rectangular-box-shaped article such as an encased audio tape cassette is wrapped in a wrapping film 1 as follows: Both end portions of the wrapping film 1 are overlapped with each other on one of the sides of the article substantially along the center line, thus forming a barrel seal portion 4. Then, a slit 5 is formed in the barrel seal portion.

In the second embodiment, too, no tear tape is employed. By pulling the edge 5*a* of the slit 5 in the direction of the arrow X in FIG. 4 the wrapping film 1 is torn into two pieces on both sides of the barrel seal portion 4. Thus, the wrapping film 1 is torn over its entire length, thus being opened similarly as in the case of the above-described first embodiment. That is, the wrapping film can be readily removed.

Modifications

Modifications of the above-described embodiments will be described with reference to FIGS. 5 through 13, which are enlarged diagrams corresponding to the encircled region A in FIG. 1. In FIGS. 5 through 13, barrel seal portions 4 are indicated by oblique lines.

First Modification

Figure 5:
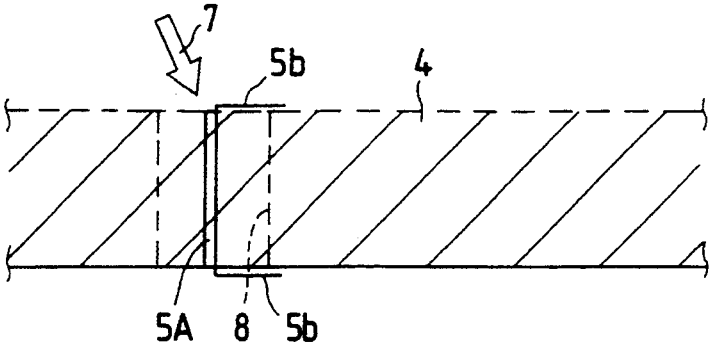
FIGS. 5 through 10 are enlarged plan views showing essential parts of first through sixth modifications of the wrapped article of the invention.

The first modification is as shown in FIG. 5. In order to locate the slit 5A with ease, an arrow mark 7 is provided beside it, or colored marks 8 are provided on both sides of the slit 5A. The colored marks 8 are preferably provided on the opposed surfaces of the overlapped end portions of the wrapping film by color printing, because the colored marks 8 thus provided reduce the degree of sticking of the wrapping film when heat-welded, which facilitates the picking of the slit 5A.

Second Modification

Figure 6:
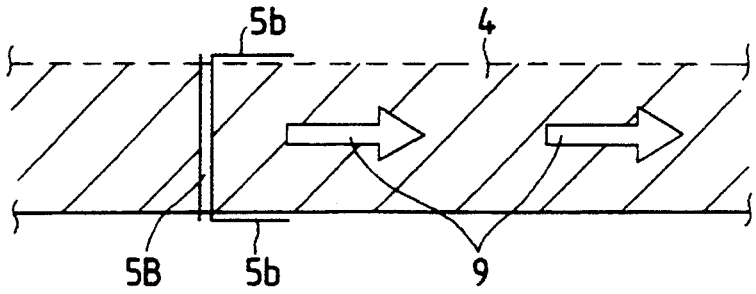

In the second modification, as shown in FIG. 6, in order to clearly specify the direction of pulling the slit 5B arrow marks 9 are printed on the barrel seal portion 4. The arrow marks 9 may be printed on one side or both sides of the barrel seal portion 4.

In each of the above-described first and second modifications, the slit (5A or 5B) is formed across the barrel seal portion 4.

Third Modification

Figure 7:
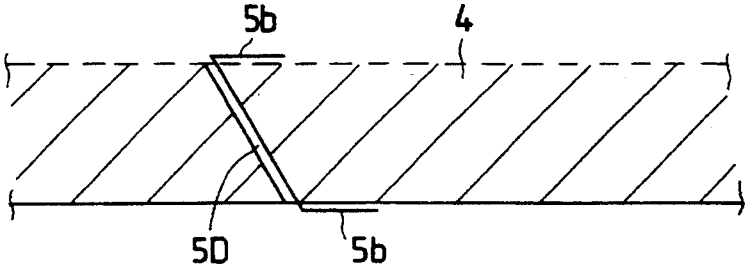

In the third modification shown in FIG. 7, the slit 5C is formed obliquely across the barrel seal portion 4, so that the tearing ear formed by the slit 5C can be picked up with ease.

Fourth Modification

Figure 8:
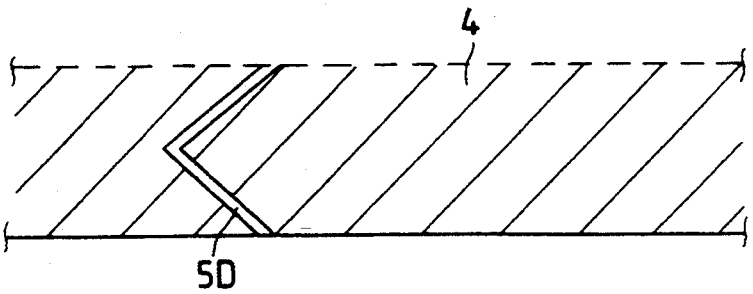

In the fourth modification shown in FIG. 8, the slit 5D is V-shaped, thus forming a V-shaped tearing ear. The V-shaped tearing ear can be picked up with ease. The edges of the V-shaped slit 5D are inclined along the tearing direction. Hence, in the fourth modification, unlike the first and second modifications shown in FIGS. 5 and 6, the slit 5D has no bent portions 5*b*; however, in starting the tearing operation, cracks are readily formed in the wrapping film.

Fifth Modification

Figure 9:
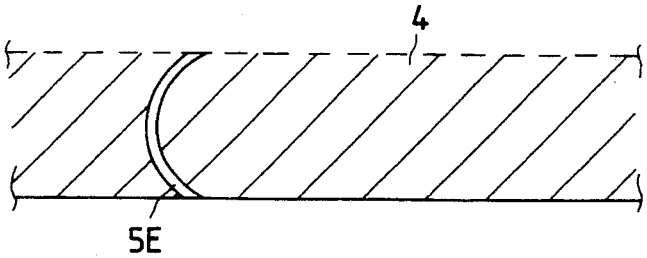

In the fifth modification shown in FIG. 9, the slit 5E is arcuate. The function of the slit 5E is substantially equal to that of the slit 5D shown in FIG. 8.

Sixth Modification

Figure 10:
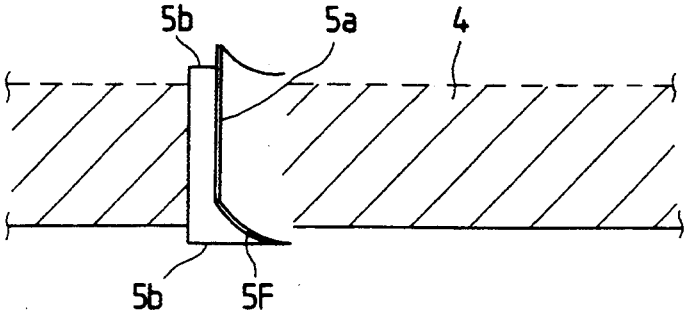

In the fifth modification shown in FIG. 10, the slit 5F is U-shaped including the bent portions 5*b*. In this modification, the nature of shrink wrapping is utilized to raise the tearing ear 5*a* formed by the slit 5F. The tearing ear 5*a* thus raised can be readily located and picked up.

Seventh Modification

Figure 11:
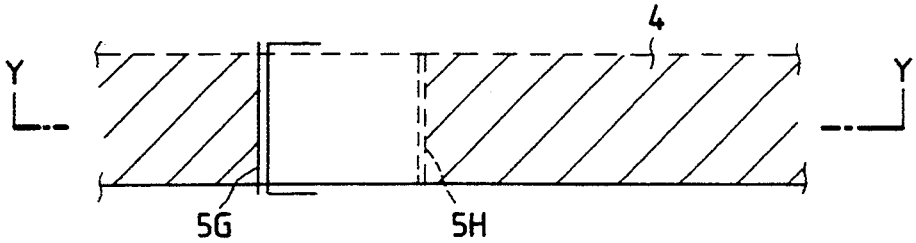
FIG. 11 is an enlarged plan view showing a seventh modification of the wrapped article of the invention.
Figure 12:
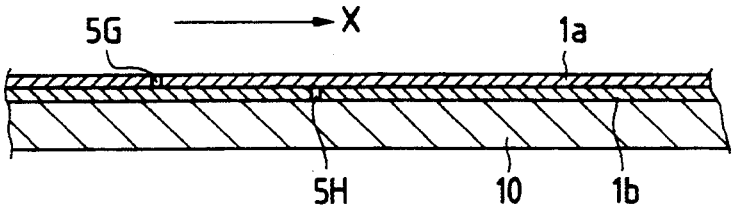
FIG. 12 is a sectional view taken along a line Y—Y in FIG. 11.

The seventh modification is as shown in FIGS. 11 and 12. In the seventh modification, a slit 5H is formed in the lower film 1*b*, and a slit 5G is formed in the upper film 1*a*. The slits 5G and 5H are shifted from each other in such a manner that the slit 5H is located downstream of the slit 5G in the tearing direction X. When the slit 5G is pulled in the direction of the arrow X as shown in FIG. 12, which is a sectional view taken along line Y—Y in FIG. 11, then the tearing operation starts. When the tearing end reaches the slit 5H, the lower film 1*b* located downstream of the slit 5H is also torn because the upper film 1*a* has been welded to the lower film.

Eighth Modification

Figure 13:
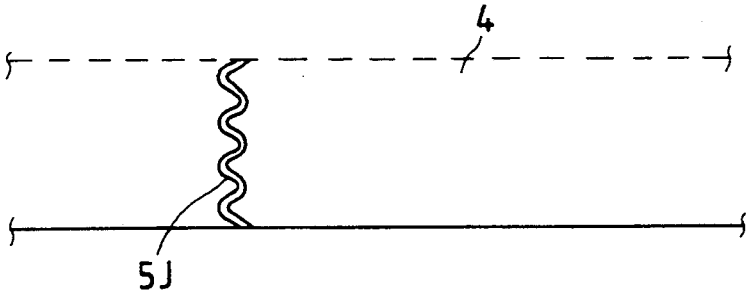
FIG. 13 is an enlarged plan view showing essential parts of an eighth modification of the wrapped article of the invention.
Figure 14:
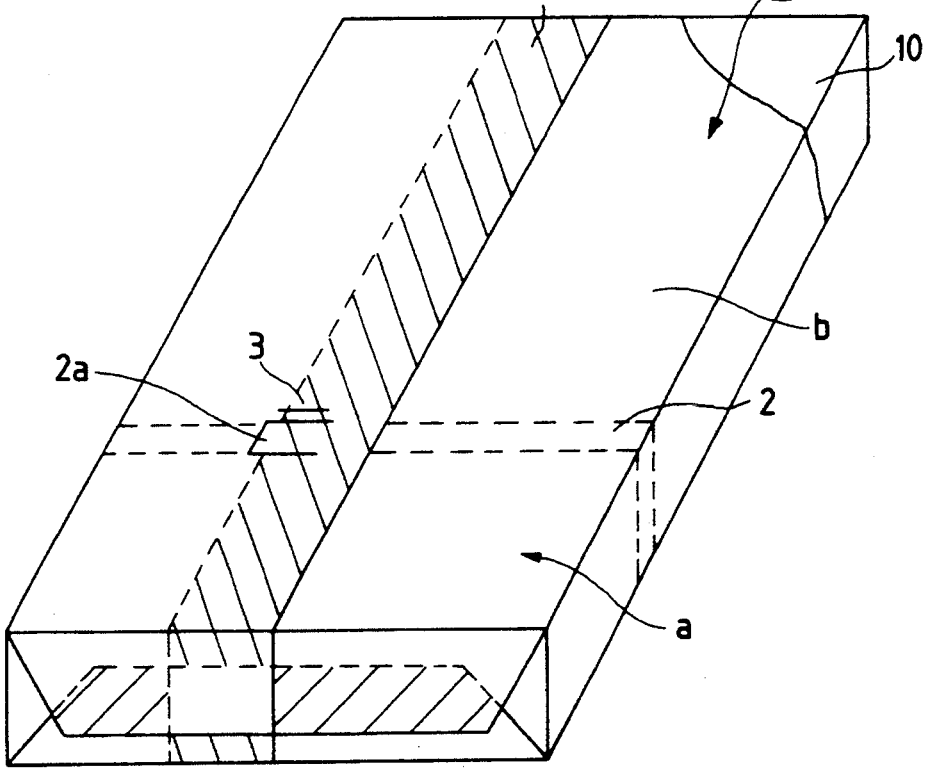
FIG. 14 PRIOR ART
FIG. 14 is a perspective view showing a conventional wrapped article.

In the eighth modification shown in FIG. 13, the slit 5J is undulating.

Effects of the Invention

As was described above, in the wrapping film according to the present invention, no tear tape is provided, and the slit is formed across the barrel seal portion so that the wrapping film can be greatly torn beginning with the barrel seal portion. Hence, the wrapped article is free from the difficulties accompanying a conventional wrapped article provided by wrapping an article in the tear tape type wrapping film, wherein the wrapping film is torn but still stuck to the article, and it takes significant time and labor to remove the film completely from the article.

The wrapping film of the present invention dispenses with the step of sticking the tear tape to the wrapping film; that is, with the wrapped article of the invention, no tear tape is required, and therefore the material cost is reduced as much.

While there has been described preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A wrapping film for wrapping an article, said wrapping film comprising a barrel seal portion formed by overlapping and sealingly engaged opposite end portions of said wrapping film, and wherein said barrel seal portion comprises a first slit formed in a lower one of the overlapping and sealingly engaged opposite end portions and a second slit formed in an upper one of the overlapping and sealingly engaged opposite end portions upstream of the first slit in a film tearing direction.

2. A wrapping film as claimed in claim 1, further comprising a mark for locating the second slit.

3. A wrapping film as claimed in claim 1, further comprising an arrow mark provided on or near the barrel seal portion for indicating a direction in which the barrel seal portion should be pulled to remove the wrapping film from the article.

4. A wrapping film as claimed in claim 1, wherein at least one of said first and second slits is substantially perpendicular tog or oblique: with, the film tearing direction.

5. A wrapping film as claimed in claim 1, wherein at least one of said first and second slits is V-shaped.

6. A wrapping film as claimed in claim 1, wherein at least one of said first and second slits is arcuate.

7. A wrapping film as claimed in claim 1, wherein at least one edge of said second slit is raised with respect to an exposed surface of said barrel seal portion.

* * * * *